US012723405B1

(12) United States Patent
Godfrey

(10) Patent No.: US 12,723,405 B1
(45) Date of Patent: Sep. 1, 2026

(54) CONSTRUCTION OF ICF WALLS WITH INTEGRAL CONCRETE BASEBOARDS AND INTERNAL CONDUITS FOR WIRING AND OTHER USES

(71) Applicant: GODFREY & COMPANY, INNOVATIONS LLC, Broken Arrow, OK (US)

(72) Inventor: Robert C. Godfrey, Broken Arrow, OK (US)

(73) Assignee: GODFREY & COMPANY, INNOVATIONS LLC, Broken Arrow, OK (US)

( * ) Notice: Subject to any disclaimer, the term of this patent is extended or adjusted under 35 U.S.C. 154(b) by 0 days.

(21) Appl. No.: 19/534,124

(22) Filed: Feb. 9, 2026

(51) Int. Cl.
*E04B 2/86* (2006.01)

(52) U.S. Cl.
CPC ..... *E04B 2/86* (2013.01); *E04B 2002/8682* (2013.01)

(58) Field of Classification Search
CPC ..... E04B 2/86; E04B 2002/8682
See application file for complete search history.

(56) References Cited

U.S. PATENT DOCUMENTS

| | | | | |
|---|---|---|---|---|
| 6,178,711 | B1 | 1/2001 | Laird et al. | |
| 7,254,925 | B2 | 8/2007 | Stefanutti et al. | |
| RE41,994 | E | 12/2010 | Mensen | |
| 8,186,128 | B2 | 5/2012 | Way | |
| 9,157,234 | B1 | 10/2015 | Foster | |
| 9,903,120 | B2 | 2/2018 | Naujoks | |
| 2002/0078649 | A1 * | 6/2002 | Clapp | E02D 27/02 249/34 |
| 2009/0202307 | A1 | 8/2009 | Au et al. | |

FOREIGN PATENT DOCUMENTS

| | | | |
|---|---|---|---|
| CN | 203160283 | 8/2013 | |
| CN | 103615007 | 3/2014 | |
| CN | 111021411 | 4/2020 | |
| DE | 102014013559 A1 * | 3/2016 | E04F 21/165 |
| FR | 2742462 | 6/1997 | |
| GB | 2625344 | 6/2024 | |

OTHER PUBLICATIONS

WO2019241842—Publication Date Dec. 26, 2019—Inventor—Cameron—Title—Wall Panel.
WO200362548—Publication Date Jul. 31, 2003—Inventor—Alvaro 2 Title—Insulated Concrete Wall Construction Method and Apparatus.

* cited by examiner

*Primary Examiner* — Patrick J Maestri
(74) *Attorney, Agent, or Firm* — Dennis D. Brown; Brown Patent Law, P.L.L.C

(57) ABSTRACT

An assembly and method for: (i) forming attractive integral concrete baseboards on ICF walls and (ii) installing electrical junction box housings or other fittings or housings in ICF walls, and running wiring and conduits through ICF walls for outlets, lights, switches and other electrical devices, without drilling channels through the concrete layer or cutting channels in the rigid foam panels of the ICF wall and without removing or compromising the integrity of the structural webs within the ICF blocks.

12 Claims, 5 Drawing Sheets

CONSTRUCTION OF ICF WALLS WITH INTEGRAL CONCRETE BASEBOARDS AND INTERNAL CONDUITS FOR WIRING AND OTHER USES

FIELD OF THE INVENTION

The present invention relates to: the construction of walls using Insulated Concrete Forms (ICFs); the formation of integral concrete baseboards on ICF walls; and the installation of internal conduits in ICF walls for running electrical wiring or for other purposes.

BACKGROUND OF THE INVENTION

Insulated Concrete Forms (ICFs) are hollow block structures that can be linked together in horizontal rows and stacked for forming insulated concrete walls for homes, commercial buildings, industrial buildings, and for other purposes. Each ICF block will typically comprise (i) an opposing pair of vertically extending, rectangular, insulating panels formed of rigid foam (commonly expanded polystyrene), (ii) plastic or steel tie structures (webs) which extend between and permanently connect the rigid foam panels together in a spaced relationship (commonly from about 6 to about 12 inches apart), (iii) furring strips which are secured on the outer ends of the webs and are embedded in the foam panels, and (iv) rebar reinforcements (typically comprising vertical and horizontal steel rods) which are held by the webs and/or otherwise positioned in the open space between the foam panels.

To construct an insulated concrete wall on the foundation of a building, the ICF blocks are linked together horizontally and dry-stacked as needed to form the desired shape and height of the wall. Concrete is then poured into the form wall to fill the open spaces between the rigid foam panels of the ICF blocks. While pouring the concrete, the webs of the ICF blocks provide structural support to prevent the forms from deforming or blowing out. In addition, to manage pressure and further assist in preventing blow outs, the concrete can be poured into the ICF wall in stages ("lifts").

However, in contrast to Symons forms or other types of concrete forms which are removed after the concrete cures, the ICF forms remain permanently in place such that (i) the rigid foam panels of the ICF blocks operate as thermal and sound insulating layers for the ICF wall, (ii) drywall or other interior finish can be attached on the foam panels on an interior side of the ICF wall, and (iii) stucco, an Exterior Insulation and Finish System (EIFS) such as Dryvit®, brick, siding, or other exterior finish can be attached on the foam panels on an exterior side of the wall.

Alternatively, drywall or other interior finish can be attached to the rigid foam panels on both sides of the ICF wall where, for example, the ICF wall is an interior wall of a building used, e.g., for constructing an interior storm shelter or safe room, or for sound proofing.

The furring strips within the rigid foam panels act as interior studs, similar to wood framing, for attaching the interior and exterior finishes to the ICF wall using screws, nails, or other attachments. The furring strips are typically spaced apart at regular intervals (commonly 6 or 8 inches on center) to provide reliable fastening points.

As with wood frame wall structures, wooden baseboards are also commonly installed on the interior sides of ICF walls. If desired, wooden baseboards can be installed on the exterior side of an ICF wall as well. Unfortunately, however, the cost of the wooden baseboard materials and the cost of the trim carpentry required for installing the baseboards add significantly to the overall cost of constructing the wall. Moreover, the installation of the baseboards can also cause delays in what is otherwise a very quick and convenient ICF construction process.

In addition, further difficulties, costs, and delays arise when it is necessary to run wiring through an ICF wall or install conduits for plumbing or other purposes. Heretofore, as one alternative, channels for the wiring or conduits have been drilled through the interior concrete layer of the ICF wall. In another alternative, the wiring or conduits have been run through channels which are (i) cut into the interior foam panels of the ICF wall in the spaces between the furring strips and then (ii) covered by drywall or other interior finish. These techniques for running wiring or conduits through ICF walls also create a significant risk of damage and can reduce the structural integrity and/or the thermal and sound insulating efficiency of the wall.

Consequently, a need exits for an improved method for providing attractive baseboards on ICF walls which eliminates the time and expense heretofore required for installing wooden baseboards. In addition, a need exists for a faster and less expensive method of running wiring and conduits through ICF walls which also eliminates the need to drill channels through the concrete layer or cut channels in the rigid foam panels of the ICF wall.

SUMMARY OF THE INVENTION

The present invention provides improved ICF wall structures and methods of construction which alleviate the problems and satisfy the needs discussed above. The inventive ICF wall structures and methods of construction provide attractive concrete baseboards which are integrally formed on the ICF walls as part of the pouring process. The inventive ICF construction method also (a) eliminates the time and expense required for installing wooden baseboards on ICF walls, (b) provides a faster and less expensive technique for running wiring and conduits through ICF walls, and (c) eliminates the need to drill channels through the concrete layer or cut channels in the rigid foam panels of the ICF wall for wiring or conduits.

In one aspect, there is provided a method of constructing a wall wherein the method comprises the formation of an assembly on a slab or other foundation, said assembly preferably comprising two or more baseboard-forming ICF blocks which are connected together in a row. Each of the baseboard-forming ICF blocks comprises (i) an upwardly extending first rigid foam panel which is positioned on a first side of the row, (ii) an upwardly extending second rigid foam panel which is positioned on a second side of the row, (iii) an interior space formed between the first and the second rigid foam panels, and (iv) the second rigid foam panel having a lower end which is spaced above the slab or other foundation.

The assembly formed on the slab or other foundation preferably also comprises opposing outer concrete form panels or other support panels between which the row of said two or more baseboard-forming ICF blocks is held. The opposing outer support panels preferably comprise (i) one or more first outer support panels positioned outside of the first side of the row of said baseboard-forming ICF blocks and (ii) one or more second outer support panels positioned outside of the second side of the row of said baseboard-forming ICF blocks.

In addition, a baseboard-forming spacer or series of baseboard-forming spacers is preferably (a) attached to the second rigid foam panels on the second side of the row of said two or more baseboard-forming ICF blocks and (b) positioned between the one or more second outer support panels and the second rigid foam panels on the second side of the row of said two or more baseboard-forming ICF blocks. The baseboard-forming spacer or series of baseboard forming spacers has (i) a bottom end, (ii) an inner edge of the bottom end which is nearest to the lower ends of the second rigid foam panels, and (iii) an outer edge of the bottom end which is substantially even with or lower than the inner edge of the bottom end and is spaced above the slab or other foundation.

The method further comprises the steps of (i) pouring concrete into the interior spaces of the baseboard-forming ICF blocks and allowing the concrete to cure at least sufficiently for removing the opposing outer support panels and the baseboard-forming spacer or series of spacers and then (ii) removing the opposing outer support panels and the baseboard-forming spacer or series of spacers.

In another aspect, there is provided a method of constructing a wall which includes the formation of an assembly on a slab or other foundation wherein the assembly preferably comprises a plurality of ICF blocks which are connected together, with each of the ICF blocks preferably comprising (i) a vertically extending first rigid foam panel, (ii) a vertically extending second rigid foam panel which is spaced apart from the first rigid foam panel, and (iii) an interior space formed between the first and the second rigid foam panels.

This assembly preferably also comprises: a junction box positioned in the interior space of one of the ICF blocks which is a selected ICF block for the junction box; a junction box extension which is positioned on the opening of the junction box and has an outer end which extends into an opening for the junction box extension which is formed in the first rigid foam panel or in the second rigid foam panel of the selected ICF block for the junction box; a removable cover on the outer end of the junction box extension; and at least one wiring conduit which is connected to the junction box.

The method further comprises the step of pouring concrete into the interior space of one or more of the ICF blocks so that the junction box and the at least one wiring conduit are encased in the concrete.

In another aspect, the assembly formed and used in the inventive method can further comprise a second wiring conduit which extends from the junction box or from the first wiring conduit to a second opening (e.g., an opening for an outlet, light, switch, or other electrical device) which is formed in the first rigid foam panel or in the second rigid foam panel of one of the ICF blocks. This ICF block can be the same as or different from the selected ICF block for the junction box.

In another aspect, there is provided a method of constructing a wall comprising forming an assembly on a slab or other foundation wherein the assembly preferably comprises a plurality of ICF blocks which are connected together, each of the ICF blocks comprising (i) an upwardly extending first rigid foam panel, (ii) an upwardly extending second rigid foam panel which is spaced apart from the first rigid foam panel, and (iii) an interior space formed between the first and the second rigid foam panels.

This assembly preferably further comprises: (a) a combined interior space of the assembly formed by a combination of the interior spaces of the ICF blocks, (b) a first foam panel wall formed by a combination of the first rigid foam panels of the ICF blocks, (c) a second foam panel wall formed by a combination of the second rigid foam panels of the ICF blocks, (d) a fitting or housing positioned in the combined interior space, (e) a first wiring conduit which extends through the combined interior space to the fitting or housing, and (f) a second wiring conduit that extends from the fitting or housing to an outlet, a light, an electrical switch, or other electrical device which is installed in and/or outside of an opening formed through the first foam panel wall.

In another aspect, the assembly constructed in accordance with this method can also comprise the outlet, the light, the electrical switch, or said other electrical device being located in a receptacle which is positioned in the opening formed through the first foam panel wall. In addition, the opening formed through the first foam panel wall will preferably be formed at a location in the first foam panel wall where a horizontal lower end of the first rigid foam panel of a first one of the ICF blocks meets a horizontal upper end of the first rigid foam panel of a second one of the ICF blocks.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
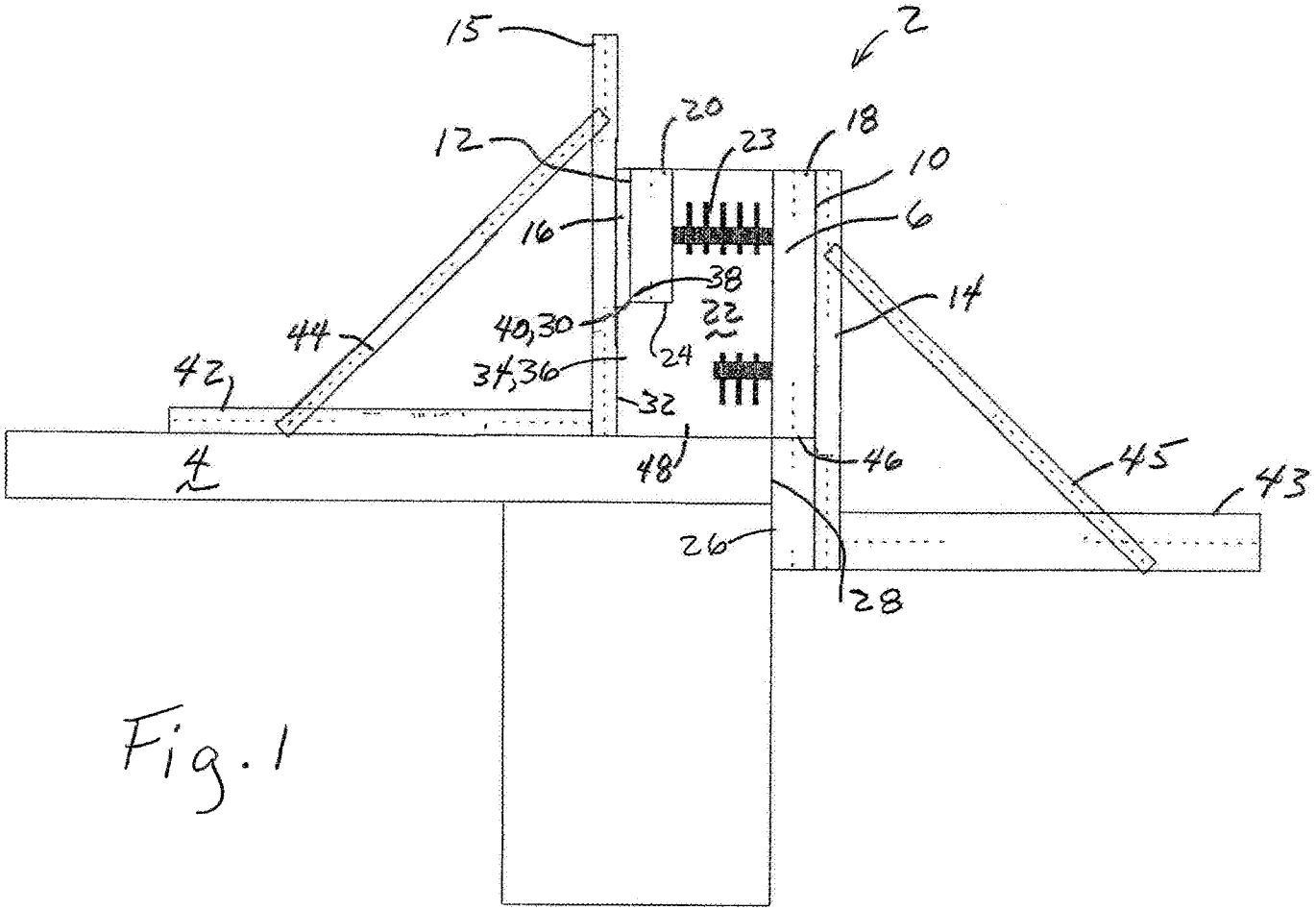
FIG. 1 is a schematic elevational end view of an embodiment 2 of an assembly used in the method of the present invention for forming an ICF wall having an integral concrete baseboard 36.
Figure 2:
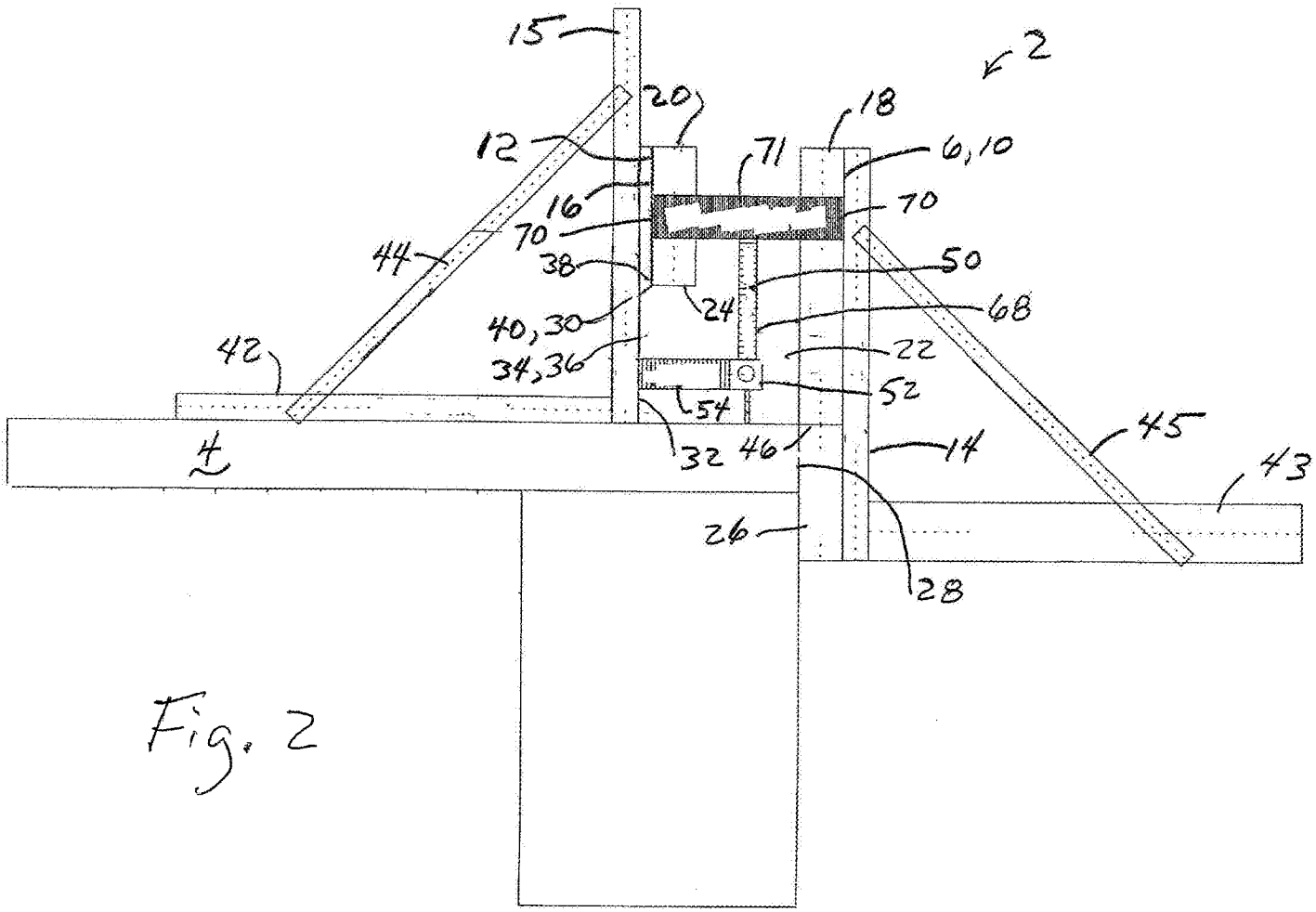
FIG. 2 is a second schematic elevational end view of the assembly 2.
Figure 3:
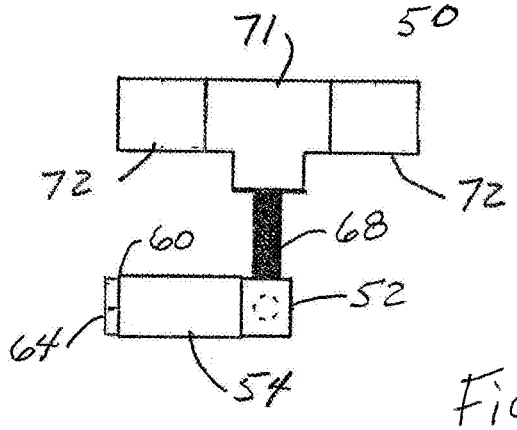
FIG. 3 schematically illustrates an electrical junction box and extension assembly 50 for installation in the inventive ICF wall.

An embodiment 2 of the assembly constructed and used in the inventive method for forming an ICF wall on a slab or other foundation 4 is illustrated in FIGS. 1 and 2. The assembly 2 preferably comprises: two or more baseboard-forming ICF blocks 6 which are connected together in a horizontal row, the row having a first side 10 and a second side 12; opposing outer concrete forms or other support panels 14 and 15 between which the row of baseboard-forming ICF blocks 6 is clamped; and a baseboard-forming spacer or series of baseboard-forming spacers 16.

Figure 5:
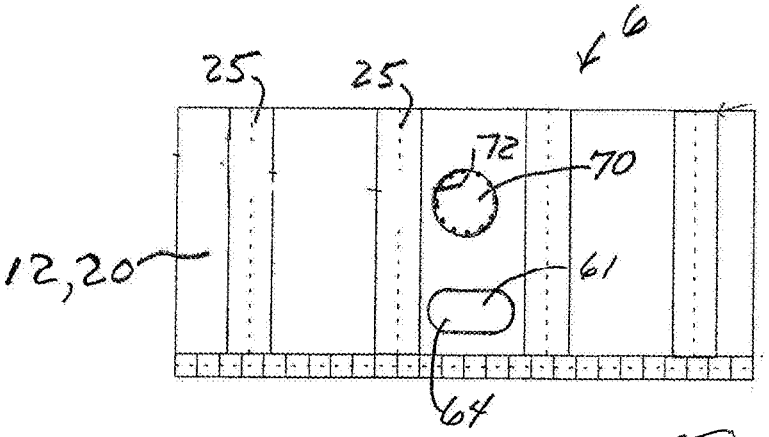
FIG. 5 is a schematic elevational front view of a portion of the inventive ICF wall.

Each of the baseboard-forming ICF blocks 6 preferably comprises (i) a vertically extending first rigid foam panel 18 which is positioned on the first side 10 of the row of blocks 6, (ii) a vertically extending second rigid foam panel 20 which is positioned on the second side 12 of the row of blocks 6, (iii) an open interior space 22 which is formed between the first and the second rigid foam panels 18 and 20, (iv) plastic or steel webs 23 which extend into or through the open interior space 22 and wherein some of the webs 23 permanently connect the rigid foam panels 18 and 20 together in a spaced relationship, (v) furring strips 25 (FIG. 5) which are secured on the outer ends of the webs 23 and are embedded in the rigid foam panels 18 and 20, and (iv) rebar reinforcements (e.g., vertical and horizontal steel rods—not shown) which are held by the webs 23 and/or otherwise positioned in the open interior space 22 between the rigid foam panels 18 and 20.

Each of the baseboard-forming ICF blocks 6 used in the inventive assembly 2 illustrated in FIGS. 1 and 2 is an inventive ICF block which is specially configured for forming an integral concrete baseboard 36 on at least one side 10 and/or 12 of the row of the two or more baseboard-forming ICF blocks 6. By way of example, but not by way of limitation, in the assembly 2 shown in FIG. 1, each of the vertically extending second rigid foam panels 20 which is positioned on the second side 12 of the row of blocks 6 has been cut or otherwise formed and/or positioned such that lower end 24 of the second rigid foam panel 20 does not reach (i.e., is spaced above) the slab or other foundation 4.

The lower ends 24 of the second rigid foam panels 20 can be spaced above the slab or other foundation 4 as needed to produce an integral baseboard 36 of any desired height. The lower ends 24 of the second rigid foam panels 20 will preferably be spaced at least 0.5 inch, at least 0.75 inch, at least 1 inch, at least 1.5 inches, at least 2 inches, at least 2.5 inches, at least 3 inches, at least 3.5 inches, at least 4 inches, at least 4.5 inches, at least 5 inches, at least 5.5 inches, at least 6.0 inches, at least 6.5 inches, at least 7 inches, at least 7.5 inches, at least 8 inches, at least 8.5 inches, at least 9 inches, or at least 10 inches above the slab or other foundation 4. The lower ends 24 of the second rigid foam panels 20 will preferably be spaced from about 0.75 inch to about 12 inches (i.e., ¼ inch), more preferably from about 1.5 to about 10 inches or from about 2 to about 9 inches, above the slab or other foundation 4.

By way of example, but not by way of limitation, an inventive baseboard-forming ICF block 6 can be formed from a starting ICF block (e.g., an ICF block of standard manufacture having a spaced-apart pair of generally rectangular rigid foam panels of equal height) by cutting or otherwise removing a bottom end segment 26 of any needed height from the bottom end of one of the rigid foam panels of the starting ICF block. As further illustrated in FIGS. 1 and 2, the bottom end segment 26 which is removed from the starting ICF block, or a shorter portion of the end segment 26, can optionally be glued or otherwise adhered to an outer vertical end or stem wall 28 of the slab or other foundation 4 for insulating, aesthetic, or other purposes.

The opposing outer concrete forms or other support panels 14 and 15 of the assembly 2, between which the row of baseboard-forming ICF blocks 6 is held, will preferably comprise (i) one or more first outer support panels 14 positioned outside of the first side 10 of the row of baseboard-forming ICF blocks 6 and (ii) one or more second outer support panels 15 positioned outside of the second side 12 of the row of baseboard-forming ICF blocks 6.

Examples of outer support panels preferred for use in the assembly 2 include, but are not limited to, steel-framed support panels such as Symons concrete form panels. In addition, it is also preferred that each of the Symons form panels 14 and 15, or at least each Symons form panel 14 and/or 15 positioned on either side 10 and/or 12 that comes into contact with the concrete poured for forming an integral concrete baseboard 36, have an inner plywood face for contacting the concrete.

The first and second outer support panels 14 and 15 can be held in clamping position on the exterior of the assembly 2 by any suitable means. For example, as illustrated in FIGS. 1 and 2, the one or more second outer support panels 15 can be retained by (i) one or more kickers or blocks 42 which are attached by screws or other suitable attachments to the slab or other foundation 4 at the base of each of the second outer panels 15 and (ii) one or more angled braces 44 having lower ends which are held by the kicker(s)/block 42 or other suitable attachments on the slab or other foundation 4 and upper ends which extend to the upper portion(s) of the one or more second outer panels 15.

Similarly, the one or more first outer support panels 14 can be retained, e.g., by (i) one or more kickers 43 which hold the bottom end(s) of the one more first outer support panels 14 and (ii) one or more angled braces 45 which extend from the one or more kickers 43 to the upper end portion(s) of the one or more first outer panels 14.

The baseboard-forming spacer or series of baseboard-forming spacers 16 used in the inventive assembly 2 is preferably a flat spacer, or series of flat spacers extending end-to-end, which (i) is attached to the second rigid foam panels 20 on the second side 12 of the row of said two or more baseboard forming ICF blocks 6 and (ii) is positioned between the one or more second outer support panels 15 and the second rigid foam panels 20 on the second side 12 of the row of said two or more baseboard-forming ICF blocks 6. By way of example, but not by way of limitation, the baseboard-forming spacer(s) 16 is/are preferably attached to second rigid foam panels 20 by screwing the baseboard-forming spacer(s) 16 to the furring strips 25 in the second rigid foam panels 20. By way of example, but not by way of limitation, the spacer(s) 16 is/are preferably formed of wood.

The bottom end 30 of the spacer or series of spacers 16, the lower ends 24 of the second rigid foam panels 20, and the lower vertical portion(s) 32 of the second outer support panel(s) 15 create a molding cavity 34 for forming the integral concrete baseboard 36 on the bottom of the ICF wall wherein (i) the thickness of the integral concrete baseboard 36 will correspond to the thickness of the spacer(s) 16 and (ii) the shape or design running along the top end of the concrete baseboard 36 will be formed by, and correspond to, the shape of the bottom end 30 of spacer or series of spacers 16.

The thickness of the baseboard-forming spacer(s) 16 will preferably be at least 0.25 inch, at least ⅜ inch, at least 0.5 inch, at least ⅝ inch, at least 0.75 inch, at least ⅞ inch, or at least 1 inch. The thickness of the baseboard-forming spacer(s) 16 will preferably be in the range of from ⅜ inch to 1.5 inch and will more preferably be in the range of from 0.5 inch to 1.25 inch.

The bottom end 30 of the baseboard-forming spacer or series of baseboard-forming spacers 16 preferably comprises (i) an inner edge 38 which is nearest to the lower ends 24 of the second rigid foam panels 20 of the baseboard-forming ICF blocks 6 and (ii) an outer edge 40 which is substantially even with (i.e., within ±⅛ inch) or lower than the inner edge 38 of the bottom end 30 of the spacer 16.

The inner edge 38 running along the bottom end 30 of the spacer or series of spacers 16 will preferably be even with or lower than the lower ends 24 of the second rigid foam panels 20 of the ICF blocks 6 and will more preferably be substantially even with the lower ends 24 of the second foam panels 20 (i.e., within ±⅛ inch).

The outer edge 40 running along the bottom end 30 of the spacer or series of spacers 16 will preferably be spaced at least ⅜ inch, at least 0.5 inch, at least ⅝ inch, at least 0.75 inch, at least 1 inch, at least 1.25 inches, at least 1.5 inches, at least 2 inches, at least 2.5 inches, at least 3 inches, at least 4 inches, at least 5 inches, at least 6 inches, at least 7 inches, at least 8 inches, or at least 9 inches above the slab or other foundation 4. The outer edge 40 of the bottom end 30 of the spacer 16 will preferably be spaced from about ⅜ inch to about 11 inches (i.e., ±0.1 inch), more preferably from about 0.5 inch to about 10 inches or from about ⅝ inch to about 9 inches, above the slab or other foundation 4.

The bottom end 30 of the baseboard-forming spacer or series of baseboard-forming spacers 16 can have any desired shape running along the length thereof for forming a corresponding molded shape running along the upper end of the integral concrete baseboard 36. The shape running along the bottom end 30 of the spacer(s) 16 can be formed, e.g., using a router or any other suitable device. As one example, a decorative shape can be formed on the upper end of the integral concrete baseboard 36 by shaping the bottom end 30 of the spacer or series of spacers 16 such that at least an outer portion of the bottom end 30 of the baseboard-forming spacer or series of spacers 16 extends laterally outward and downwardly at an angle, or curves laterally outward and downwardly, to the outer edge 40 of the bottom end 30 of the spacer or series of spacers 16.

If the second rigid foam panels 20 of the baseboard-forming ICF blocks 6 are prefabricated with finished exterior surfaces (e.g., a Dryvit® or other EIFS finish) such that no additional drywall or other interior or exterior finish will be attached over the finished surface, the bottom end 30 of the baseboard-forming spacer or series of spacers 16 can be shaped to extend laterally outward and downwardly at an angle, or curve laterally outward and downwardly, all the way from the inner edge 38 of the bottom end 30 to the outer edge 40 of the bottom end 30.

On the other hand, if the attachment of drywall or other interior or exterior finish is desired or necessary, the bottom end 30 of the spacer or series of spacers 16 can include, for example, a flat horizontal segment which extends outwardly from the inner edge 38 of the bottom end 30 to a distance which is preferably substantially equal to the thickness of the drywall or other finish. The flat horizontal segment on the bottom 30 of the spacer or series of spacers 16 will form a flat ledge on the upper end of the concrete baseboard 36 on which the bottom end of the drywall or other finish can rest.

In the assembly 2 illustrated in FIGS. 1 and 2, the lower ends 46 of the first rigid foam panels 18 on the first side 10 of the row of two or more baseboard-forming ICF panels 6 are positioned on the segments 26 of rigid foam (removed from the bottom ends of the second rigid foam panels 20) which have been glued or otherwise adhered to the outer vertical end or stem wall 28 of the slab or other foundation 4. The lower ends 46 of the first rigid foam panels 18 are also substantially even (flush) with the upper surface of the slab or other foundation 4 (i.e., within ±0.25 inch). It will be understood, however, that the lower ends 46 of the first rigid foam panels 18 can alternatively be positioned on, spaced above, or lower than the upper surface of the slab or other foundation 4.

Once the inventive assembly 2 is formed, the inventive method further comprises the step of pouring concrete into the open interior spaces 22 of the two or more baseboard-forming ICF blocks 6 such that the concrete fills the baseboard molding cavity 34 created by the bottom end 30 of the spacer or series of spacers 16, the lower ends 24 of the second rigid foam panels 20, and the lower vertical portion(s) 32 of the second outer support panel(s) 15. A water stop seal strip 48 will preferably be provided in and project from the upper surface of the slab or other foundation 4 to prevent water infiltration between the slab or other foundation 4 and the ICF wall. After pouring, the concrete is preferably allowed to at least cure sufficiently that the opposing outer support panels 14 and 15 and the baseboard-forming spacer or series of spacers 16 can be removed.

Although only the second rigid foam panels 20 of the inventive baseboard-forming ICF blocks 6 are shown in FIGS. 1 and 2 as being cut or otherwise formed and configured such that the lower ends 24 of the second rigid foam panels 20 do not reach (i.e., are spaced above) the slab or other foundation 4, it will be understood that the first rigid foam panels 18 on the other side 10 of the row of blocks 6 can also, or alternatively, be cut or otherwise formed and configured in the same manner as described above for forming integral baseboards on either or both sides of the wall. On each side 10 and/or 12 of the wall on which an integral concrete baseboard 36 is formed, a baseboard-forming spacer or series of baseboard-forming spacers 16 will also be used in the same manner as discussed above for setting the width/thickness of the integral baseboard 36 and forming a decorative or other shape along the top of the baseboard 36.

It will also be understood that the inventive baseboard-forming ICF blocks 6 (*i*) can be straight for forming a straight wall or wall segment or (ii) can be curved (see FIG. 4) for forming a curved wall or wall segment.

An electrical junction box and conduit assembly 50 provided by the present invention for ICF walls is illustrated in FIGS. 2-5. The inventive electrical conduit assembly 50 preferably comprises an electrical junction box housing 52 which is positioned in the open interior space 22 of a baseboard-forming ICF block 6 between the vertical first and second rigid foam panels 18 and 20 of the ICF block 6. It will be understood, however, that the ICF block 6 can alternatively be a standard ICF block. In accordance with the inventive method, the ICF block 6 will be one of a plurality of baseboard-forming, standard, and/or other ICF blocks which are connected together for forming a wall or a portion of a wall.

As additionally illustrated in FIGS. 2-5, the inventive electrical conduit assembly 50 further comprises: (i) a junction box extension 54 which is positioned on and extends from the opening of the junction box housing 52 and (ii) a pair of wiring conduits 56 and 58 which extend to and from the junction box 52. The junction box extension 54 has an outer end 60 which extends through the integral concrete baseboard 36 or into an opening 61 for the junction box extension 54 which is formed in the second rigid foam panel 20, or alternatively in the first rigid foam panel 18, of the ICF block 6. A removable cover 64 is attached over the opening in the outer end 60 of the extension 54 for providing access to the wiring in the junction box 52. A gasket is also preferably positioned beneath the cover 64 and around the outer opening of the extension 54 for sealing the opening.

The junction box extension 54 will preferably be provided as part of a junction box kit wherein the junction box extension 54 can be cut to whatever length may be necessary for the particular wall in question. If permitted by code, the junction box extension 54 can be cut to a length such that the outer cover 64 for the extension 54 extends to and is covered by the outer finish provided on the wall. However, if required by code, the outer end 54 of the extension 52 will also extend through the dry wall, stucco, EIFS, or other outer finish provided on the wall.

Figure 4:
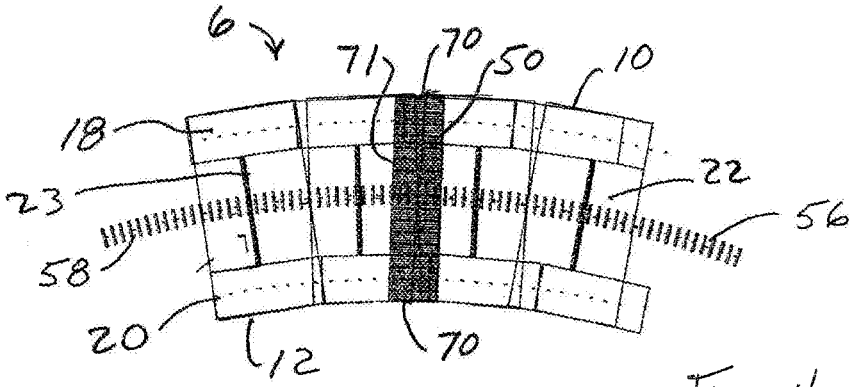
FIG. 4 is a schematic cutaway top view of a portion of the inventive ICF wall having the electrical junction box assembly 50 installed therein. The ICF wall, which can be straight or curved, is shown in FIG. 4 as a curved wall merely for illustration purposes.

As also illustrated in FIGS. 2 and 4, the inventive electrical conduit assembly 50 additionally comprises another wiring conduit 68 which extends from the junction box 52 or one of the other wiring conduits 56 or 58. The conduit 68 extends directly to an opening 70, or to a tee 71 or other fitting for one or more openings 70, for one or more outlets, lights, switches, other electrical devices, or a combination thereof. The opening(s) 70 is/are formed in the first rigid foam panel 18 and/or in the second rigid foam panel 20 of one of the ICF blocks 6 (which may be the same as or different from the selected ICF block 6 for the junction box 52). A grommet and/or other receptacle 72 is also preferably positioned in each opening 70 for holding the outlet, light, switch, or other electrical device and/or holding a cover or a lighting lens.

The junction box housing 52, the junction box extension 54, the wiring conduits 56, 58, and 68, and the receptacle(s) 72 will preferably be formed of PVC but can alternatively be formed of other materials which meet code and are suitable for this service. The junction box 52 can generally be of any shape desired. The cross-sectional shape of the junction box extension 54 will preferably correspond to the shape of the opening 60 the junction box housing 52 so that the extension 54 can be positioned on and extend from the junction box opening 60.

The inventive method will preferably further comprise the step of pouring concrete into the open interior space(s) 22 of one or more of the ICF blocks 6 such that the junction box 52, junction box extension 54, conduits 56, 58, and 68, and the tee 71 are encased in the concrete.

Figure 6:
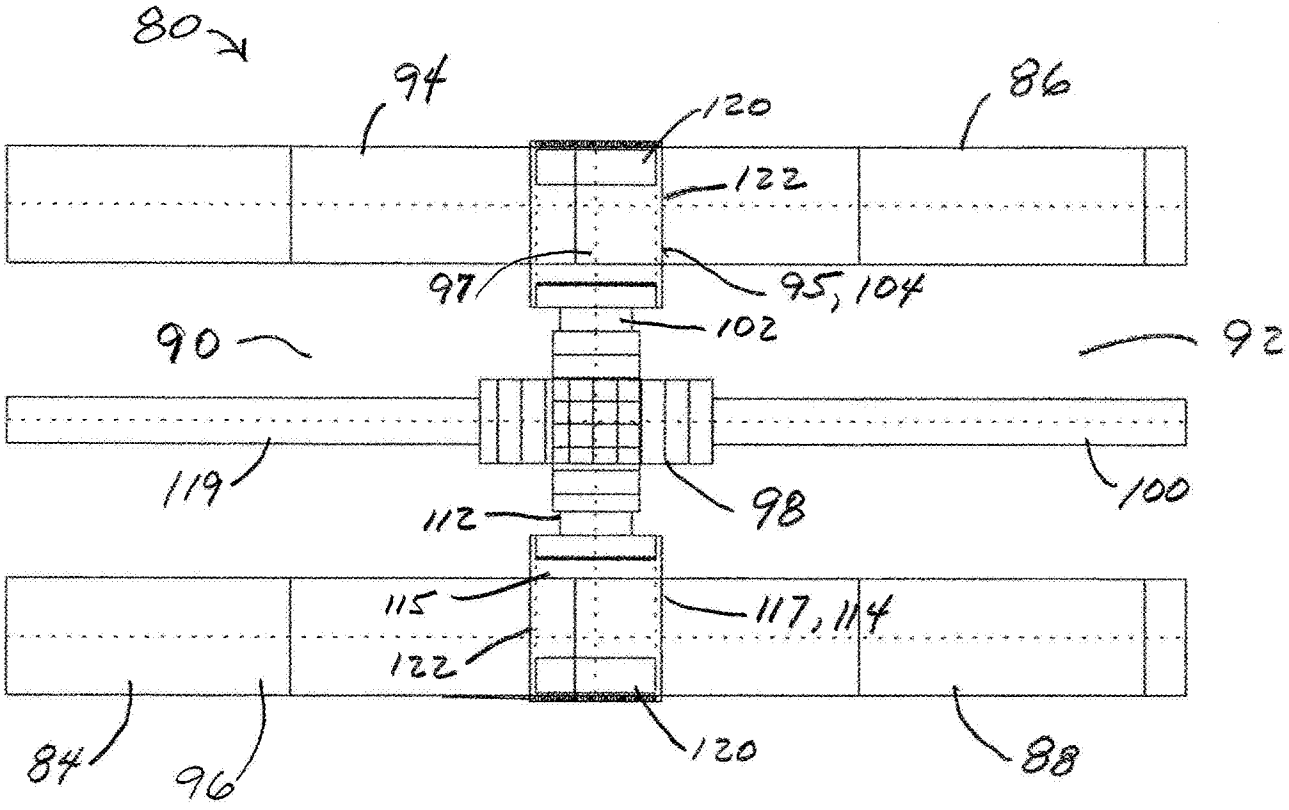
FIG. 6 is a schematic top view of an alternative embodiment 80 of an assembly used in the method of the present invention for forming an ICF.
Figure 7:
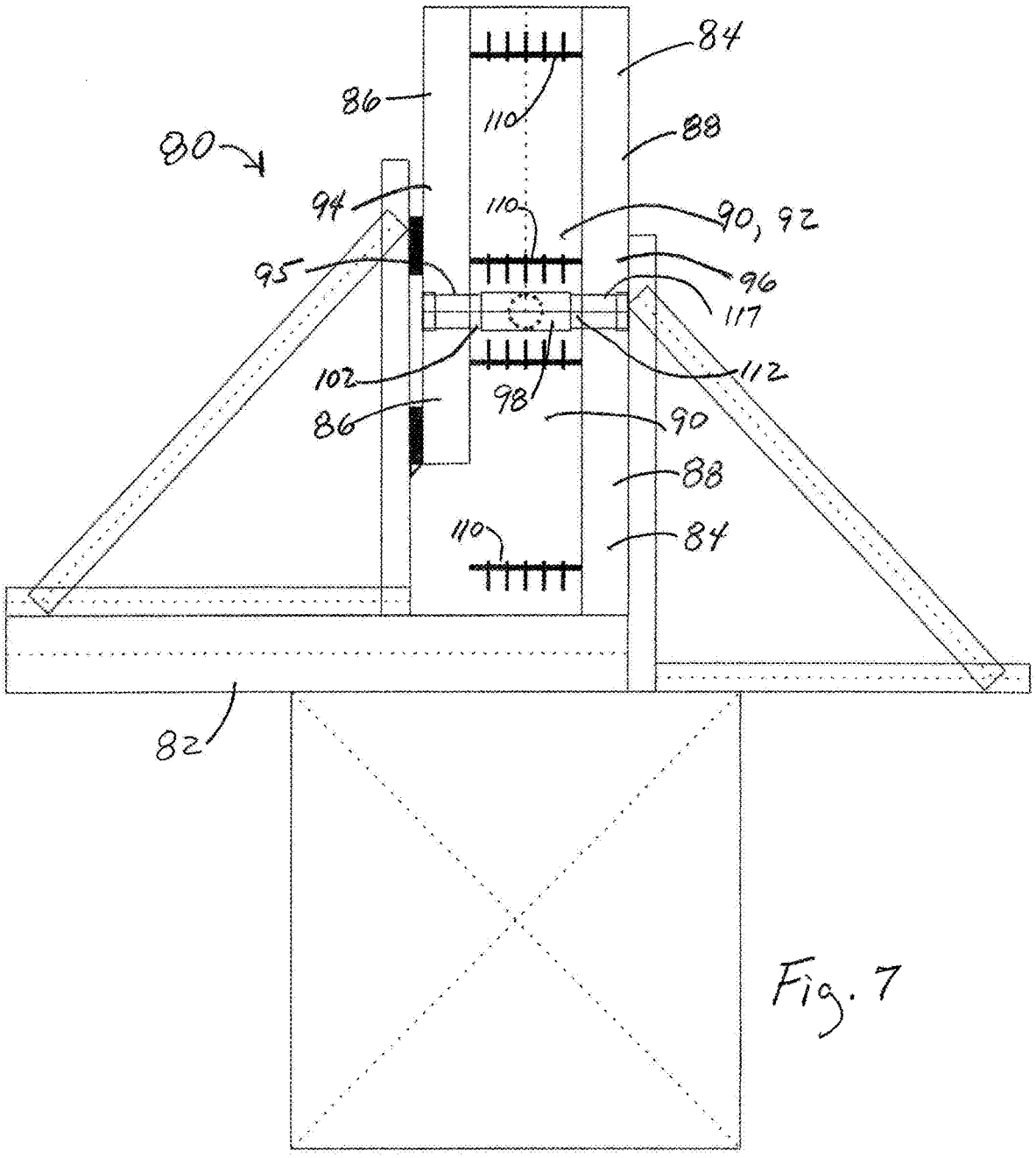
FIG. 7 is an elevational end view of the inventive assembly 80.

In another embodiment, the method of the present invention for constructing a wall can comprise the construction of an alternative ICF assembly 80, as illustrated in FIGS. 6 and 7, on a slab or other foundation 82. The assembly 80 comprises a plurality of ICF blocks 84 which are connected together, wherein each of the ICF blocks 84 comprises (i) an upwardly extending first rigid foam panel 86, (ii) an upwardly extending second rigid foam panel 88 which is spaced apart from the first rigid foam panel 86, and (iii) an interior space 90 formed between the first and the second rigid foam panels 86 and 88.

A combined interior space 92 is formed in the inventive assembly 80 by the combination of the interior spaces of the plurality of ICF blocks 84. In addition, a first foam panel wall 94 is formed by the combination of the first rigid foam panels 86 of the ICF blocks 84. Similarly, a second foam panel wall 96 is formed by the combination of the second rigid foam panels 88 of the ICF blocks 84.

The inventive assembly 80 further comprises: a fitting or housing 98 (e.g., an elbow, a TEE, or other suitable fitting or housing) which is positioned in the combined interior space 92; a first wiring conduit 100 which extends through the combined interior space 92 to the fitting or housing 98; and a second wiring conduit 102 that extends from the fitting or housing 98 to an electrical outlet, a light (e.g., a recessed light or LED lighting), an electrical switch, or other electrical device 97 which is positioned in and/or outside of an opening 95 formed through the first or the second foam panel wall 94 or 96. The outlet, the light, the electrical switch, or said other electrical devices 97 is preferably located in a receptacle 104 which is positioned in the opening 95 formed through the foam panel wall 94 or 96.

In the inventive assembly 80, the receptacle 104 and the opening 95 therefor, when located, e.g., in the first foam panel wall 94, will preferably be positioned at a location where the horizontal lower end of the first rigid foam panel 86 of a first ICF block 84 meets a horizontal upper end of the first rigid foam panel 86 of a second ICF block 84 which is positioned below the first ICF block 84. The fitting or housing 98 will also preferably be positioned in the combined interior space 92 at the location where the bottom of the first ICF block 84 meets the top of the second ICF block 84 so that the fitting or housing 98, the receptacle 104, the first wiring conduit 100, and the second wiring conduit 102 cause minimal or no interference with, and require minimal or no removal of, any of the reinforcing webs 110 which extend between the first rigid foam panels 86 and the second rigid foam panels 88 of any of the ICF blocks 84.

As also illustrated in FIGS. 6 and 7, the inventive assembly 80 can further comprise a third wiring conduit 112 that extends from the fitting or housing 98 (e.g., a TEE or other suitable fitting) to an electrical outlet, a light (e.g., a recessed light or LED lighting), an electrical switch, or other electrical device 115 which is installed in and/or outside of an opening 117 formed through the opposite foam panel wall 94 or 96. The outlet, the light, the electrical switch, or said other electrical device 115 will also preferably be located in a receptacle 114 which is positioned in the opening 117 formed through the other foam panel wall 94 or 96. Moreover, the second receptacle 114 and the opening 117 will preferably be positioned, e.g., in the second foam panel wall 96, at a location where a horizontal lower end of the second rigid foam panel 88 of the first one of the ICF blocks 84 meets a horizontal upper end of the second rigid foam panel 88 of the second one of the ICF blocks 84.

Once again, the TEE or other fitting or housing 98, the receptacles 104 and 114, and the first, second, and third wiring conduits 100, 102, and 112 (as well as any additional wiring conduit 119 that may extend from the fitting or housing 98) will preferably be positioned in the combined interior space 92 of the inventive assembly 80 at the location where the bottom of the first ICF block 84 meets the top of the second ICF block 84 so that the fitting or housing 98, the receptacles 104 and 114, and the first, second, third and/or other wiring conduits 100, 102, 112, 119 will cause minimal or no interference with, and will require minimal or no removal of, any of the reinforcing webs 110 which extend between the first rigid foam panels 86 and the second rigid foam panels 88 of any of the ICF blocks 84.

The inventive method also comprises pouring concrete into the combined interior space 92 so that the elbow, TEE, or other fitting or housing 98 and the wiring conduits 100, 102, 112, and/or 119 are encased in the concrete.

By way of example, but not by way of limitation, each of the receptacles 104 and 114 can comprise (i) a grommet 120, cover, and/or a lens which extends into or is positioned in or over the outer end of the opening 94 and/or 117 and/or (ii) a segment of plastic pipe, a pipe fitting, or any other type of cup or cylinder 122 which is in compliance with the applicable electrical code for holding the electrical device 97 or 115.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and as set forth in the claims.

What is claimed is:

1. A method of constructing a wall comprising steps of:

a) forming an assembly on a slab or other foundation comprising two or more baseboard-forming ICF blocks which are connected together in a row, each of the two or more baseboard-forming ICF blocks comprising (i) an upwardly extending first rigid foam panel which is positioned on a first side of the row, (ii) an upwardly extending second rigid foam panel which is positioned on a second side of the row, (iii) an interior space formed between the first and the second rigid foam panels, and (iv) the second rigid foam panel having a lower end which is spaced above the slab or other foundation, opposing outer support panels between which the row of said two or more baseboard-forming ICF blocks is held, the opposing outer support panels comprising (i) one or more first outer support panels positioned outside of the first side of the row of said two or more baseboard-forming ICF blocks and (ii) one or more second outer support panels positioned outside of the second side of the row of said two or more baseboard-forming ICF blocks, each of the one or more second outer support panels having an inner upwardly extending contacting face, and a baseboard-forming spacer or series of baseboard-forming spacers which is attached to the second rigid foam panels on the second side of the row of said two or more baseboard-forming ICF blocks and is positioned between the one or more second outer support panels and the second rigid foam panels on the second side of the row of said two or more baseboard-forming ICF blocks, the baseboard-forming spacer or series of baseboard-forming spacers having (i) a bottom end, (ii) an inner edge of the bottom end which is nearest to the lower ends of the second rigid foam panels, and (iii) an outer edge of the bottom end which is substantially even with or lower than the inner edge of the bottom end and is spaced above the slab or other foundation, and a baseboard-forming cavity having (i) an upper end defined by the bottom end of the baseboard-forming spacer or series of baseboard-forming spacers, (ii) an outer upwardly extending side defined by the inner upwardly extending contacting face(s) of the one or more second outer support panels, and (iii) a bottom end defined by an upper surface of the slab or other foundation;

b) pouring concrete into the interior spaces of the two or more baseboard-forming ICF blocks and into the baseboard-forming cavity and allowing the concrete to cure at least sufficiently for removing the opposing outer support panels and the baseboard-forming spacer or series of baseboard-forming spacers; and then c) removing the opposing outer support panels and the baseboard-forming spacer or series of baseboard-forming spacers.

2. The method of claim 1 further comprising the inner edge of the bottom end of the baseboard-forming spacer or series of baseboard-forming spacers being substantially even with or lower than the lower ends of the second rigid foam panels.

3. The method of claim 1 further comprising each of the first rigid foam panels on the first side of the row of said two or more baseboard-forming ICF blocks having a lower end which is on, even with, or lower than an upper surface of the slab or other foundation.

4. The method of claim 1 further comprising at least an outer portion of the bottom end of the baseboard-forming spacer or series of baseboard-forming spacers extending laterally outward and downwardly at an angle, or curving laterally outwardly and downwardly, to the outer edge of the bottom end of the baseboard-forming spacer or series of baseboard-forming spacers.

5. The method of claim 1 further comprising the lower ends of the second rigid foam panels on the second side of the row of the two or more baseboard-forming ICF blocks being spaced at least 1 inch above the slab or other foundation.

6. The method of claim 1 further comprising the baseboard-forming spacer or series of baseboard-forming spacers having a thickness of at least % inch.

7. The method of claim 1 further comprising forming each of the two or more baseboard-forming ICF blocks from a starting ICF block having a spaced apart pair of rigid foam panels of equal height by removing a bottom end segment from one of the rigid foam panels of the starting ICF block.

8. The method of claim 7 further comprising (i) the bottom end segments removed from the starting ICF blocks, or shorter segments thereof, being glued or otherwise adhered to an outer vertical end or stem wall of the slab or other foundation and (ii) the first rigid foam panels of the two or more baseboard-forming ICF blocks being positioned on the bottom end segments or the shorter segments thereof.

9. A method of constructing a wall comprising steps of:

a) forming an assembly on a slab or other foundation comprising two or more baseboard-forming ICF blocks which are connected together in a row, each of the two or more baseboard-forming ICF blocks comprising (i) an upwardly extending first rigid foam panel which is positioned on a first side of the row, (ii) an upwardly extending second rigid foam panel which is positioned on a second side of the row, (iii) an interior space formed between the first and the second rigid foam panels, and (iv) the second rigid foam panel having a lower end which is spaced above the slab or other foundation, each of the first rigid foam panels on the first side of the row of said two or more baseboard-forming ICF blocks having a lower end which is on, even with, or lower than an upper surface of the slab or other foundation, opposing outer support panels between which the row of said two or more baseboard-forming ICF blocks is held, the opposing outer support panels comprising (i) one or more first outer support panels positioned outside of the first side of the row of said two or more baseboard-forming ICF blocks and (ii) one or more second outer support panels positioned outside of the second side of the row of said two or more baseboard-forming ICF blocks, and a baseboard-forming spacer or series of baseboard-forming spacers which is attached to the second rigid foam panels on the second side of the row of said two or more baseboard-forming ICF blocks and is positioned between the one or more second outer support panels and the second rigid foam panels on the second side of the row of said two or more baseboard-forming ICF blocks, the baseboard-forming spacer or series of baseboard-forming spacers having (i) a bottom end, (ii) an inner edge of the bottom end which is nearest to the lower ends of the second rigid foam panels, and (iii) an outer edge of the bottom end which is substantially even with or lower than the inner edge of the bottom end and is spaced above the slab or other foundation;

b) pouring concrete into the interior spaces of the two or more baseboard-forming ICF blocks and allowing the concrete to cure at least sufficiently for removing the opposing outer support panels and the baseboard-forming spacer or series of baseboard-forming spacers; and then c) removing the opposing outer support panels and the baseboard-forming spacer or series of baseboard-forming spacers.

10. A method of constructing a wall comprising steps of:

a) forming an assembly on a slab or other foundation comprising two or more baseboard-forming ICF blocks which are connected together in a row, each of the two or more baseboard-forming ICF blocks comprising (i) an upwardly extending first rigid foam panel which is positioned on a first side of the row, (ii) an upwardly extending second rigid foam panel which is positioned on a second side of the row, (iii) an interior space formed between the first and the second rigid foam panels, and (iv) the second rigid foam panel having a lower end which is spaced above the slab or other foundation, opposing outer support panels between which the row of said two or more baseboard-forming ICF blocks is held, the opposing outer support panels comprising (i) one or more first outer support panels positioned outside of the first side of the row of said two or more baseboard-forming ICF blocks and (ii) one or more second outer support panels positioned outside of the second side of the row of said two or more baseboard-forming ICF blocks, and a baseboard-forming spacer or series of baseboard-forming spacers which is attached to the second rigid foam panels on the second side of the row of said two or more baseboard-forming ICF blocks and is positioned between the one or more second outer support panels and the second rigid foam panels on the second side of the row of said two or more baseboard-forming ICF blocks, the baseboard-forming spacer or series of baseboard-forming spacers having (i) a bottom end, (ii) an inner edge of the bottom end which is nearest to the lower ends of the second rigid foam panels, and (iii) an outer edge of the bottom end which is lower than the inner edge of the bottom end and is spaced above the slab or other foundation, at least an outer portion of the bottom end of the baseboard-forming spacer or series of baseboard-forming spacers extending laterally outward and downwardly at an angle, or curving laterally outwardly and downwardly, to the outer edge of the bottom end of the baseboard-forming spacer or series of baseboard-forming spacers;

b) pouring concrete into the interior spaces of the two or more baseboard-forming ICF blocks and allowing the concrete to cure at least sufficiently for removing the opposing outer support panels and the baseboard-forming spacer or series of baseboard-forming spacers; and then c) removing the opposing outer support panels and the baseboard-forming spacer or series of baseboard-forming spacers.

11. A method of constructing a wall comprising steps of:

a) forming an assembly on a slab or other foundation comprising two or more baseboard-forming ICF blocks which are connected together in a row, each of the two or more baseboard-forming ICF blocks comprising (i) an upwardly extending first rigid foam panel which is positioned on a first side of the row, (ii) an upwardly extending second rigid foam panel which is positioned on a second side of the row, (iii) an interior space formed between the first and the second rigid foam panels, and (iv) the second rigid foam panel having a lower end which is spaced above the slab or other foundation, opposing outer support panels between which the row of said two or more baseboard-forming ICF blocks is held, the opposing outer support panels comprising (i) one or more first outer support panels positioned outside of the first side of the row of said two or more baseboard-forming ICF blocks and (ii) one or more second outer support panels positioned outside of the second side of the row of said two or more baseboard-forming ICF blocks, and a baseboard-forming spacer or series of baseboard-forming spacers which is attached to the second rigid foam panels on the second side of the row of said two or more baseboard-forming ICF blocks and is positioned between the one or more second outer support panels and the second rigid foam panels on the second side of the row of said two or more baseboard-forming ICF blocks, the baseboard-forming spacer or series of baseboard-forming spacers having (i) a bottom end, (ii) an inner edge of the bottom end which is nearest to the lower ends of the second rigid foam panels, and (iii) an outer edge of the bottom end which is substantially even with or lower than the inner edge of the bottom end and is spaced above the slab or other foundation;

b) pouring concrete into the interior spaces of the two or more baseboard-forming ICF blocks and allowing the concrete to cure at least sufficiently for removing the opposing outer support panels and the baseboard-forming spacer or series of baseboard-forming spacers; and then c) removing the opposing outer support panels and the baseboard-forming spacer or series of baseboard-forming spacers, the method further comprising forming each of the two or more baseboard-forming ICF blocks from a starting ICF block having a spaced apart pair of rigid foam panels of equal height by removing a bottom end segment from one of the rigid foam panels of the starting ICF block.

12. The method of claim 11 further comprising (i) the bottom end segments removed from the starting ICF blocks, or shorter segments thereof, being glued or otherwise adhered to an outer vertical end or stem wall of the slab or other foundation and (ii) the first rigid foam panels of the two or more baseboard-forming ICF blocks being positioned on the bottom end segments or the shorter segments thereof.

* * * * *